United States Patent [19]

Yajima et al.

[11] Patent Number: 4,756,086

[45] Date of Patent: Jul. 12, 1988

[54] PEN PRINTER

[75] Inventors: Hiroshi Yajima; Masaki Hayashi, both of Tokyo, Japan

[73] Assignee: Casio Computer Co., Ltd., Tokyo, Japan

[21] Appl. No.: 862,481

[22] Filed: May 12, 1986

[30] Foreign Application Priority Data

| | | | |
|---|---|---|---|
| May 16, 1985 | [JP] | Japan | 60-104471 |
| May 16, 1985 | [JP] | Japan | 60-104473 |
| May 16, 1985 | [JP] | Japan | 60-104474 |

[51] Int. Cl.[4] ..... B43L 13/00

[52] U.S. Cl. ..... 33/18.1; 33/1 M; 33/27.01

[58] Field of Search ..... 33/1 M, 1 C, 18 R, 23.03, 33/27.01; 346/139 R, 29, 139 B, 139 C

[56] References Cited

U.S. PATENT DOCUMENTS

| | | | |
|---|---|---|---|
| 3,638,319 | 2/1972 | Barlow et al. | 33/18.1 |
| 4,197,550 | 4/1980 | Held | 33/18.1 X |
| 4,277,893 | 7/1981 | Munther | 33/18.1 |
| 4,459,602 | 7/1984 | Anderka et al. | 33/18.1 X |
| 4,528,754 | 7/1985 | Houldsworth | 33/18.1 |

FOREIGN PATENT DOCUMENTS

| | | | |
|---|---|---|---|
| 8103561 | 12/1981 | PCT Int'l Appl. | 33/430 |

*Primary Examiner*—Harry N. Haroian

*Attorney, Agent, or Firm*—Frishauf, Holtz, Goodman & Woodward

[57] ABSTRACT

A pen printer for performing drawing with a detachably held pen comprises a pen holder operation mechanism for moving a pen holder detachably holding the pen between a pen attaching position, where the pen is attached to or detached from the pen holder, and a home position, where drawing is started or ended, and for moving the pen holder from the home position for drawing a desired sign or figure according to a pattern corresponding to the desired sign or figure and causing the pen holder to return to the home position, a support member for supporting the pen holder operation mechanism to be movable in all directions, a pen seat, mounted on the support member, for receiving a tip of the pen held by the pen holder, pen attaching position reference point display marks, mounted on the pen seat, for displaying a pen attaching position reference point for the pen tip of the pen held by the pen holder, and pen holder operation mechanism moving screws for moving the pen holder operation mechanism in all directions so as to align the pen tip of the pen hold by the pen holder in the pen attaching position with the pen attaching position reference position.

22 Claims, 15 Drawing Sheets

PEN PRINTER

BACKGROUND OF THE INVENTION

The present invention relates to a pen printer for drawing desired figures and signs such as characters or numeric values with a detachable pen on paper.

In a conventional pen printer of the type described above, a pen is detachably held in a pen holder and the pen holder is driven in different directions to draw desired figures and signs such as characters or numeric values with the pen. In this case, the pen held by the pen holder is moved with the home position as a reference point. Pen printers include compact ones (e.g., CADLINER, available from MAX Inc.) for drawing parts numbers and names in drawings and large-sized ones for drawing large drawings. The principle of operation of these pen printers is the same as that of X-Y plotters. Pens used in the above pen printers are replaced with other pens to change colors and line thicknesses of figures to be drawn on paper. In the conventional pen printers, however, only special pens (whose pen body portions held by the pen holder have the same diameter) are used, and commercially available general pens (body portions held by the pen holder have different diameters) such as ball-point pens and felt pens (generally called sign or marking pens) cannot be used. A conventional pen holder consists of a pen support member for receiving one side of the pen body and a pen press member for pressing the other side of the pen body. The tip of the pen held in the pen holder is located at a position separated from the pen support member toward the pen body by half of the distance between the pen support member and the pen body (if the pen tip is aligned with the central axis of the pen body). Even if various types of special pens having the same diameter and the same pen tip position are selectively held in the pen holder, the pen tip position is always the same. However, when a pen having a diameter different from that of the special pen is held in the pen holder, the pen tip position is different from that of the special pen. The positions of figures and signs drawn by general-purpose pens deviate from those drawn by the special pens. In particular, when a special pen is replaced with a general-purpose pen during drawing of figures or signs, the sign positions on each line are not aligned and deviations in lines in the figure become distinct.

In a conventional X-Y plotter having the same principle of operation as that of the pen printer, a pen is moved along X- and Y-axes to draw figures and signs (including characters and numeric values). The conventional X-Y plotter includes a carrier frame driven along guide rails and moved along the Y-axis and a pen support member supported by the carrier frame and driven along a direction (i.e., the X-axis) perpendicular to the moving direction of the carrier frame. The pen support member is moved along the X-axis by a pen support drive mechanism (e.g., a belt drive mechanism) arranged in the carrier frame. In the conventional X-Y plotter, a Y drive mechanism for moving the carrier frame along the Y-axis is arranged independently of an X drive mechanism for moving the pen support member along the X-axis. In a conventional compact plotter for drawing only small signs such as characters and numeric values, the X and Y drive mechanisms must be accommodated in a small space, resulting in a complicated structure.

A self-driven pen printer is known as another conventional pen printer which runs along the paper surface to draw a desired figure.

The self-driven pen printer is also called a pen robot and a typical example thereof is "TURTLE", (tradename) available from TERAPIN Inc. This pen printer includes a running member, a pen holder and a pen holder operation mechanism. The running member has two drive wheels and two free-running wheels and runs along the paper surface. The pen holder is located at an intermediate position between the two drive wheels. The pen holder operation mechanism causes the pen holder carried on the running member to move vertically, thereby bringing the pen in contact with the paper surface or separating it therefrom. The running member can be driven in any direction by controlling the rotational speed and direction of the two drive wheels. The pen held in the pen holder is brought in contact with the paper surface upon downward movement of the pen holder and draws a figure or sign corresponding to the moving pattern of the running member. For example, if the running member runs linearly, a straight line can be drawn on the paper surface. If the running member is turned, an arc can be drawn on the paper surface.

When one of the two drive wheels is stopped while the other continues to be driven so that the running member is turned with the minimum radius of rotation, the radius of the drawn arc (the arc whose center is the stopped drive wheel) is ½ of the distance between the two drive wheels, because the pen holder is located at the intermediate position between the two drive wheels. The conventional self-driven pen printer cannot draw an arc having a radius smaller than ½ of the distance between the two drive wheels.

In the conventional self-driven pen printer, since the pen holder is located at the intermediate position between the two drive wheels, the line drawn on the paper surface with the pen cannot be visually checked until the printer passes the drawn line. It is thus impossible to draw a desired figure by visually controlling the printer running direction. In other words, only figures of predetermined patterns preset in a printer controller can be drawn in the conventional self-driven pen printer.

SUMMARY OF THE INVENTION

Given the above situation, it is a first object of the present invention to provide a pen printer wherein the pen tip home position is always the same regardless of the diameter of a pen body selectively held by a pen holder, and drawing deviations from the desired positions and irregular lines can be prevented.

It is a second object of the present invention to provide a pen printer with a compact structure.

It is a third object of the present invention to provide a self-driven pen printer wherein an arc having a radius smaller than ½ of the distance between two drive wheels can be drawn, and the running direction of the printer can be controlled while a contact position of the pen on the paper surface is visually checked.

The first object of this invention is achieved by a pen printer for performing drawing with a detachably held pen; comprising: a pen holder for detachably holding the pen; a pen holder operation mechanism for moving the pen holder between a pen attaching position, where the pen is attached to or detached from the pen holder, and a home position, where drawing is started or ended, and for moving the pen holder from the home position for drawing a desired sign or figure according to a pattern corresponding to the desired sign or figure and causing the pen holder to return to the home position; a support member for supporting the pen holder operation mechanism to be movable in all directions; a pen seat, mounted on the support member, for receiving a tip of the pen held by the pen holder; pen attaching position reference point display means, mounted on the pen seat, for displaying a pen attaching position reference point for the pen tip of the pen held by the pen holder; and pen holder operation mechanism moving means for moving the pen holder operation mechanism in all directions so as to align the pen tip of the pen held by the pen holder in the pen attaching position with the pen attaching position reference position.

In the pen printer which is so constructed that it is able to achieve the first object of this invention, it is preferable that the pen holder operation mechanism moving means comprises front-and-back and right-and-left feed screws, threadably engaged with the support member or the pen holder operation mechanism to move back or forth upon rotation, for moving the pen holder operation mechanism in back-and-forth and right-and-left directions.

The pen holder operation mechanism moving means which is so constructed as described above makes the construction thereof to be simple.

In the pen printer which is so constructed that it is able to achieve the first object of this invention, the support member may has running means which runs on a paper surface subjected to drawing with the pen held by the pen holder.

The support member which is so constructed as described above makes the pen printer to be able to draw figure or sign which has a relatively large dimensions and is not be able be drawn by only using the pen holder operation mechanism.

The second object of the invention as described above is achieved by a pen printer comprising a pen holder for detachably holding a pen and a pen holder operation mechanism for moving the pen holder according to a pattern corresponding to a desired sign or figure so as to cause the pen to draw the desired sign or figure on a paper surface, wherein the pen holder operation mechanism comprises: a base; a carrier frame supported on said base so as to be movable along a Y-axis; a pen support member, supported by the carrier frame so as to be movable along an X-axis perpendicular to the Y-axis, for supporting the pen holder; four pulleys rotatably mounted in the carrier frames, the four pulleys being respectively located at corners of a parallelogram having two parallel sides parallel to the Y-axis and two other parallel sides parallel to the X-axis; a pair of rotary drums rotatably mounted on the base so as to be spaced apart on an X-axis line passing through a middle point of the parallelogram; a pair of motors coupled to the pair of rotary drums to independently rotate the pair of rotary drums in a forward or reverse direction; a pulley and a drive string fixing portion which are mounted on the pen support member, the pulley and the drive string fixing portion being spaced apart on an X-axis line passing through the middle point of the parallelogram; and a drive string looped around the pulley of the pen support member, two of the four pulleys which are near the pulley of the pen support member, the pair of rotary drums on the base, and the remaining two of the four pulleys which are near the drive string fixing portion on the pen support member, both ends of the drive string being fixed to the drive string fixing portion on the pen support member.

In the pen printer which is so constructed that it is able to achieve the second object of this invention, it is preferable that the pair of motors are stepping motors, respectively.

The overall size of the stepping motor is small and it is easy to control the rotation of output shaft of the stepping motor.

In the pen printer which is so constructed that it is able to achieve the second object of this invention, the pen printer may further comprise a base support member for supporting the base of the pen holder operation mechanism and the base support member may be provided with running means which runs on the paper surface subjected to drawing with the pen held by the pen holder.

By further constructing the pen printer, which is so constructed that it is able to achieve the second object of this invention, as descried above, the printer can draw figure or sign which has a relatively large dimensions and is not be able to be drawn by only using the pen holder operation mechanism.

In the pen printer which is so constructed that it is able to achieve the second object of this invention, the pen holder operation mechanism may move the pen holder between a pen attaching position, where the pen is attached to or detached from said pen holder, and a home position, where drawing is started or ended, and may move the pen holder from the home position for drawing a desired sign or figure according to a pattern corresponding to the desired sign or figure and causes the pen holder to return to the home position, and the pen printer may further comprise: a support member for supporting the base of the pen holder operation mechanism to be movable in all directions; a pen seat, mounted on the support member, for receiving a tip of the pen held by the pen holder; pen attaching position reference point display means, mounted on the pen seat, for displaying a pen attaching position reference point for the pen tip of the pen held by the pen holder; and pen holder operation mechanism moving means for moving the pen holder operation mechanism in all directions so as to align the pen tip of the pen held by the pen holder in the pen attaching position with the pen attaching position reference position.

By constructing the pen printer, which is so constructed that it is able to achieve the second object of this invention, as described above, the pen printer can achieve the first object of this invention.

In the pen printer which is so constructed as to be able to achieve the first and second objects of this invention, in order to make the construction of the pen holder operation mechanism moving means simple, it is preferable that the pen holder operation mechanism moving means comprises front-and-back and right-and-left feed screws, threadably engaged with the support member or the base of the pen holder operation mechanism to move back or forth upon rotation, for moving the pen holder operation mechanism in back-and-forth and right-and-left directions.

The third object of this invention is achieved by a pen printer for performing drawing with a detachably held pen, comprising: a pen holder for detachably holding the pen; a pen holder operation mechanism for vertically moving the pen holder to bring the pen held by said pen holder into contact with a paper surface subjected to drawing of a desired sign or figure or to separate the pen therefrom; and a running member for accommodating the pen holder operation mechanism therein, the running member being provided with two drive wheels spaced away from each other, rotating center axes of the two drive wheels being aligned, and wheel drive means for independently driving the two drive wheels, the pen holder operation mechanism being provided with an arm for positioning the pen holder outside the running member on a straight line passing through the axes of said two drive wheels.

In the pen printer which is so constructed that it is able to achieve the third object of this invention, it is preferable that a distance between the pen holder and one of the drive wheels which is close to the pen holder is shorter than a distance between the two drive wheels.

With this construction, it is possible to shorten the length of the arm, and thus the construction of the pen printer becomes compact.

In the pen printer which is so constructed that it is able to achieve the third object of the invention, it is preferable that a ratio of the distance between the pen holder and one of the drive wheels which is close to the pen holder to the distance between the two drive wheels is an integer and that the wheel driving means of the running member rotates the two drive wheels such that a ratio of two drive wheel speeds is an integer ratio.

With this construction, control of the pen printer becomes simple.

The wheel driving means which is constructed by two stepping motors makes the construction and control thereof become easy.

In the pen printer which is so constructed that it is able to achieve the third object of the invention, the pen holder operation mechanism may move the pen holder between a pen attaching position, where the pen is attached to or detached from the pen holder, and a home position, where drawing is started or ended, and may move the pen holder from the home position for drawing a desired sign or figure according to a pattern corresponding to the desired sign or figure and causes the pen holder to return to the home position, and the pen printer further may comprise a support member for supporting the pen holder operation mechanism to be movable in all directions; a pen seat, mounted on the support member, for receiving a tip of the pen held by the pen holder; pen attaching position reference point display means, mounted on the pen seat, for displaying a pen attaching position reference point for the pen tip of the pen held by the pen holder; and pen holder operation mechanism moving means for moving the pen holder operation mechanism in all directions so as to align the pen tip of the pen held by the pen holder in the pen attaching position with the pen attaching position reference position.

With this arrangement, the pen printer, which is so constructed that it is able to achieve the third object of the invention, can also achieve the first object of this invention.

In the pen printer which is so constructed that it is able to achieve the third object of the invention, the pen holder operation mechanism may comprise: a base; a carrier frame supported on the base so as to be movable along a Y-axis; a pen support member, supported by the carrier frame so as to be movable along an X-axis perpendicular to the Y-axis, for supporting the pen holder; four pulleys rotatably mounted in the carrier frames, the four pulleys being respectively located at corners of a parallelogram having two parallel sides parallel to the Y-axis and two other parallel sides parallel to the X-axis; a pair of rotary drums rotatably mounted on the base so as to be spaced apart on an X-axis line passing through a middle point of the parallellogram; a pair of motors coupled to the pair of rotary drums to independently rotate the pair of rotary drums in a forward or reverse direction; a pulley and a drive string fixing portion which are mounted on the pen support member, the pulley and the drive string fixing portion being spaced apart on an X-axis line passing through the middle point of the parallelogram; and a drive string looped around the pulley of the pen support member, two of the four pulleys which are near the pulley of the pen support member, the pair of rotary drums on the base, and the remaining two of the four pulleys which are near the drive string fixing portion on the pen support member, both ends of the drive string being fixed to the drive string fixing portion on the pen support member, wherein the pen holder may be moved according to a pattern corresponding to a desired sign or figure so as to cause the pen held by the pen holder to draw the desired sign or figure on a paper surface.

With this construction, the pen printer, which is so constructed that it is able to achieve the third object of this invention, can also achieve the second object of this invention.

BRIEF DESCRIPTION OF THE DRAWINGS

FIGS. 22 to 25 are plan views schematically showing different operations of the combination of the pen support member and the carrier frame in FIG. 13, in which FIG. 22 shows a state where a pair of rotary drums are rotated simultaneously in the same direction to move the combination toward the front side of the pen printer, FIG. 23 shows a state where one of the pair of rotary drums is stopped and the other is kept rotating to move the combination in the front left direction of the pen printer, FIG. 24 shows a state where the pair of rotary drums are rotated in opposite directions to move the combination to the right in the pen printer, and FIG. 25 shows a state where one of the pair of rotary drums is rotated and the other is stopped to move the combination in the front right direction of the pen printer;

Various embodiments of the present invention will be described in detail with reference to the accompanying drawings.

DETAILED DESCRIPTION OF THE PREFERRED EMBODIMENTS

An embodiment of a pen printer to achieve the first object of the present invention will be described hereinafter.

Figure 1:
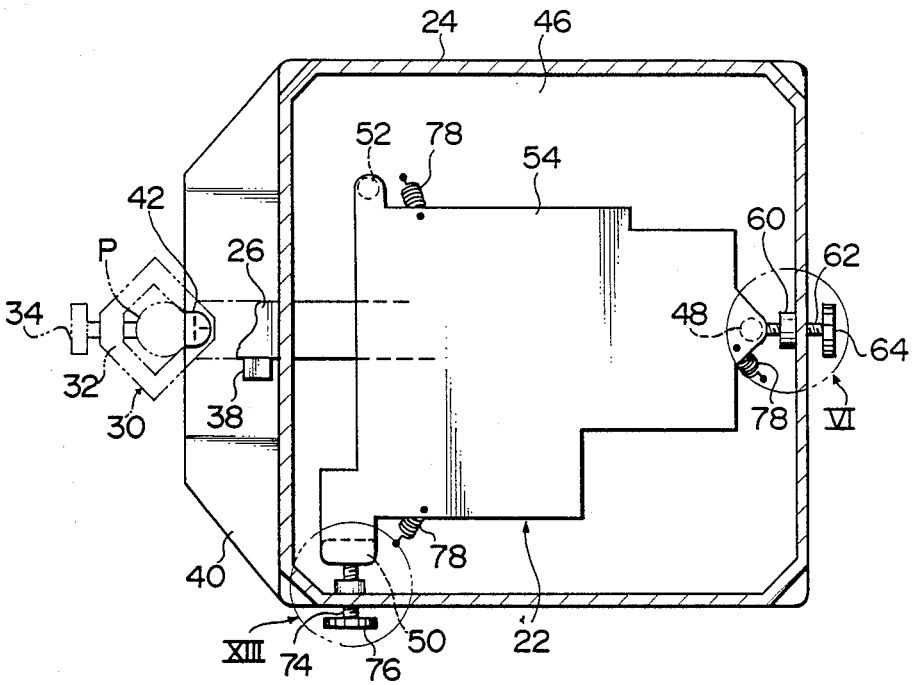
FIG. 1 is a horizontal sectional view schematically showing a self-driven pen printer according to an embodiment for achieving the first object of the present invention.
Figure 2:
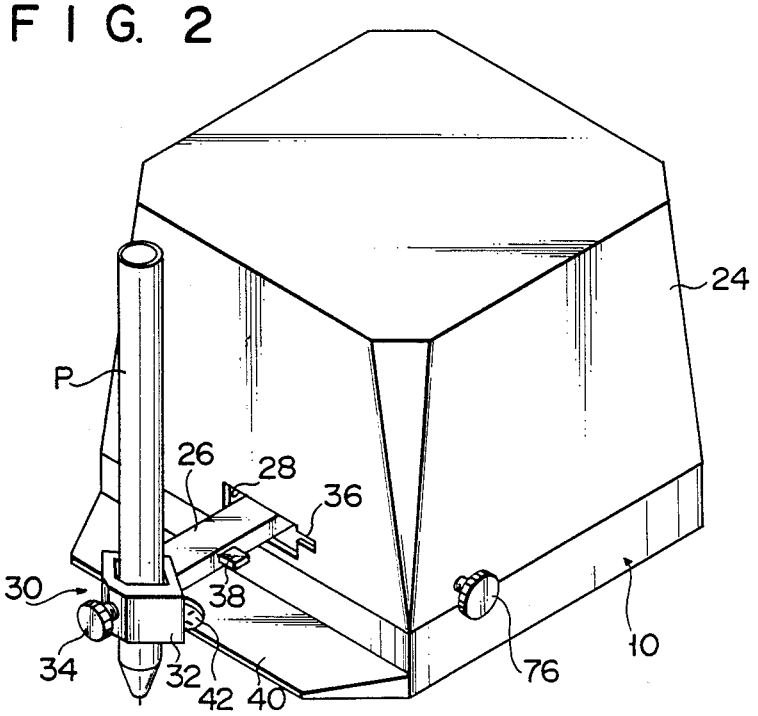
FIG. 2 is a perspective view of the self-driven pen printer in FIG. 1.
Figure 3:
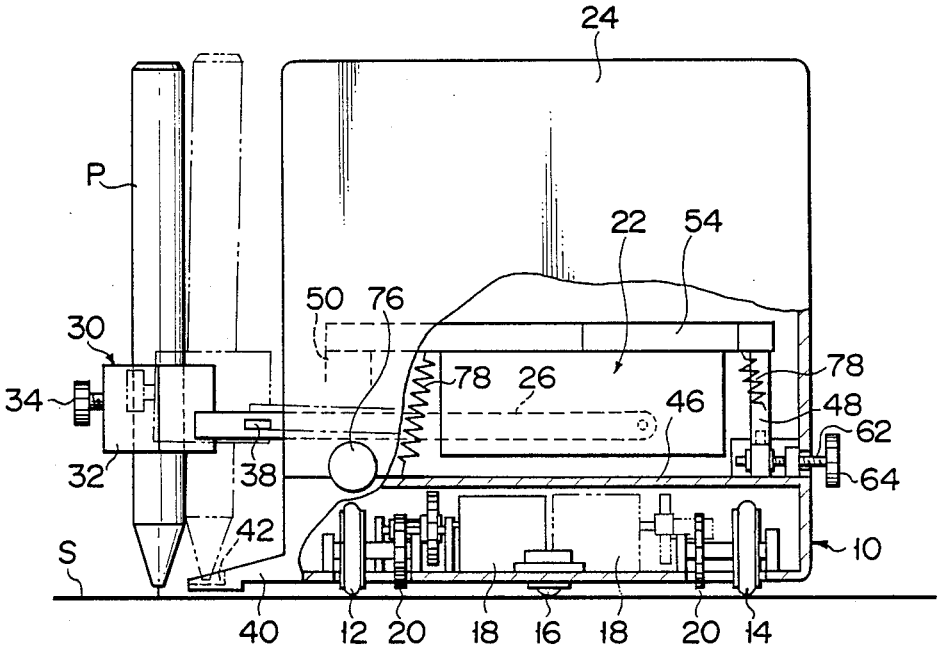
FIG. 3 is a schematic side view of the self-driven pen printer in FIG. 1, the side wall of which is partially removed.

Referring to FIGS. 1 to 3, reference numeral 10 denotes a running member adapted to run on a paper surface. Running member 10 includes drive wheels 12 and 14 at the front and rear centers, respectively. Running member 10 also includes free-running ball wheels 16 at the right and left centers, respectively. Drive wheels 12 and 14 are rotated by pulse motors 18 through reduction gear mechanisms 20, respectively. Running member 10 controls the rotational speeds of two drive wheels 12 and 14 to drive the pen printer straight or turn it.

Reference numeral 22 denotes a pen holder operation mechanism (to be referred to as a pen operation mechanism hereinafter) mounted in running member 10. Pen operation mechanism 22 is covered with cover 24 mounted on running member 10. Cover 24 accommodates a battery (not shown) for driving running member 10 and pen operation mechanism 22, and a control circuit (not shown) for receiving control signals (radio wave or optical signal) from another control device (e.g., a combination of a personal computer and a printer control signal generator) independently of the self-driven pen printer of this embodiment and controlling running of running member 10 and operation of pen operation mechanism 22.

Figure 4:
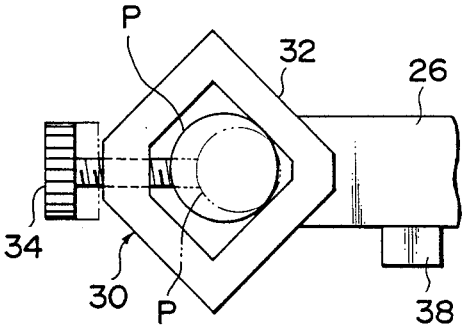
FIG. 4 is an enlarged plan view of a pen holder in the self-driven pen printer shown in FIG. 1.

Reference numeral 26 denotes a pen holder arm arranged in pen operation mechanism 22. The distal end of arm 26 projects from opening 28 formed in the front surface of cover 24. Reference numeral 30 denotes a pen holder mounted at the distal end of arm 26. Various types of commercially available pens (e.g., ball-point pens, pencils, and felt pens) can be detachably and selectively attached to pen holder 30. As best shown in FIG. 4, pen holder 30 comprises substantially hollow square rod 32, through which pen P extends, and pen fastening screw 34, threadably engaged with one side wall of hollow square rod 32. In pen holder 30 having the structure described above, pen P is vertically inserted in hollow square rod 32 and the pen body is urged by screw 34 against the inner surface of hollow square rod 32, thereby holding pen P. Therefore, pen holder 30 can selectively hold pens P of different diameters. A pen of large diameter is indicated by the solid line in FIG. 4 and a pen of small diameter is indicated by the two-dots chain line.

Pen operation mechanism 22 has a Z-axis feed function for moving pen holder arm 26 vertically to bring the pen tip of pen P held in pen holder 30 into contact with paper surface S or separate it therefrom, and a sign writing function (i.e., the X-Y plotter function) for moving arm 26 along the X- and Y-axes to cause pen P held in pen holder 30 to draw signs such as characters and numeric values. The sign writing function is performed while running member 10 is stopped. Running member 10 is moved to the next sign writing position when each sign writing cycle is completed. Pen operation mechanism 22 causes pen holder 30 to temporarily move to the home position when one sign is to be drawn and then move from the home position to a draw a predetermined sign.

When pen P is attached to pen holder 30 or pen P held by pen holder 30 is replaced with another, pen holder 30 is moved outside the pen moving range by withdrawing the pen holder arm 26 in pen operation mechanism 22. Pen operation mechanism 22 will be described in detail later.

Projection 38 is formed at one side of pen holder arm 26 and is fitted in groove 36 formed at one side of opening 28 of cover 24 when pen holder arm 26 withdraws pen holder 30 until pen holder 30 reaches the pen attaching position. Attachment or detachment of pen P with respect to pen holder 30 can be performed by fitting of projection 38 in groove 36 while vertical movement of pen holder arm 26 is inhibited.

Figure 5:
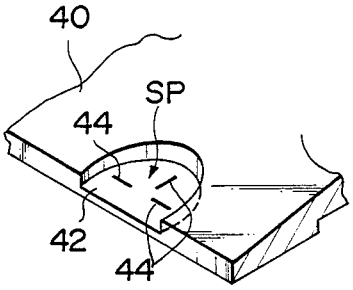
FIG. 5 is an enlarged perspective view showing pen attaching position reference point SP on a pen tip receiving surface formed in an extension board of the self-driven pen printer in FIG. 1.

Reference numeral 40 denotes an extension board extending from the lower edge of the front surface of running member 10 in the front direction. However, extension board 40 does not extend into the pen movement region for drawing the sign. Flat pen receiving surface 42 is formed on the upper surface of the center (i.e., the portion corresponding to the pen attaching position) of the front end of extension board 40 to receive the tip of pen P inserted in hollow rod 32 of pen holder 30 at the pen attaching position. Pen attaching position reference point SP is indicated by three substantial T-shaped mark lines 44 (as best shown in FIG. 5) on pen receiving surface 42. Reference point SP is separated from the home position for writing the sign by a predetermined distance (i.e., a distance from the home position of pen holder 30 to the pen attaching position).

Pen operation mechanism 22 is supported on pen operation mechanism support surface 46 as the upper surface of running member 10, and can be moved along the back-and-forth and the right-and-left (lateral) directions.

More specifically, reference numeral 48 in FIGS. 1 and 3 denotes a single support leg for supporting the center of the rear portion of pen operation mechanism 22; and 50 and 52, two support legs for supporting the right and left ends of the front portion of pen operation mechanism 22. Legs 48, 50, and 52 are vertically fixed on base plate 54 of pen operation mechanism 22.

Figure 6:
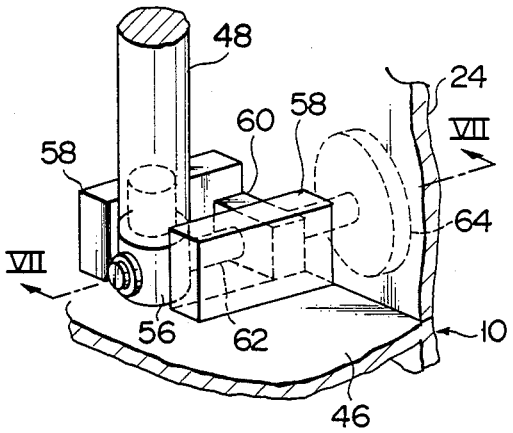
FIG. 6 is an enlarged perspective view of a back-and-forth feed screw surrounded by circle VI of the one-dot chain line in FIG. 1.
Figure 7:
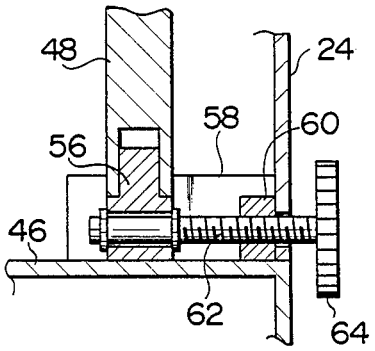
FIG. 7 is a longitudinal sectional view of the back-and-forth feed screw in FIG. 6.

Rear support leg 48 has a columnar shape, as shown in FIGS. 6 and 7. A leg member 56 is pivotally fitted in the lower end portion of near support leg 48 and can be slid along support surface 46. Reference numerals 58 denote a pair of guide walls formed on support surface 46. Leg member 56 of rear support leg 48 is guided by guide walls 58 and can be moved in the back-and-forth direction (the back-and-forth direction of pen operation mechanism 22, i.e., the right-and-left direction in FIG. 1). Reference numeral 60 denotes a nut fixed on the outer edge of support surface 46 between guide walls 58; and reference numeral 62 denotes a back-and-forth feed screw threadably engaged with nut 60. Feed screw 62 extends along the back-and-forth direction of pen operation mechanism 22. The free end of screw 62 rotatably extends through leg member 56 in rear support leg 48. The proximal end of screw 62 extends outside from the rear surface of cover 24. Knob 64 is fixed to the proximal end of screw 62. If feed screw 62 is rotated in one or the other direction, feed screw 62 is moved back or forth in the corresponding direction. Leg member 56 of near support leg 48 is moved together with screw 62, and hence pen operation mechanism 22 as a whole is moved along the back-and-forth direction.

Figure 8:
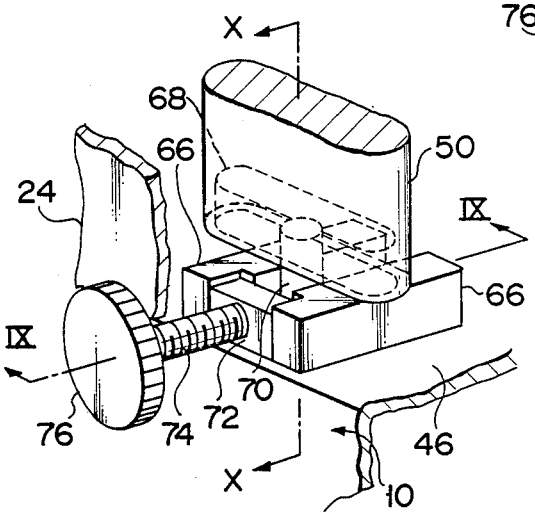
FIG. 8 is an enlarged perspective view of a right-and-left feed screw surrounded by circle VIII of the one-dot chain line in FIG. 1.
Figure 9:
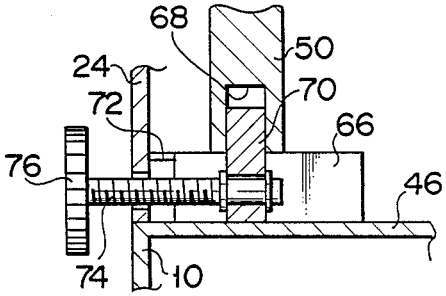
FIG. 9 is a longitudinal sectional view of the feed screw in FIG. 8 taken along the line IX—IX thereof.
Figure 10:
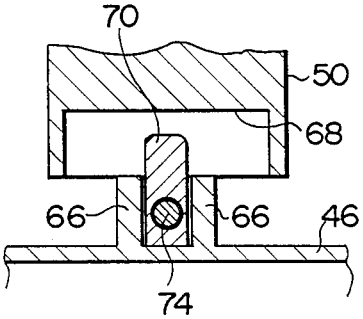
FIG. 10 is a cross-sectional view of the feed screw in FIG. 8 taken along the line X—X thereof.

As shown in FIGS. 8 to 10, left support leg 50 in pen operation mechanism 22 has a wide columnar shape wherein the back-and-forth length is greater than the right-and-left length. The lower end face of leg 50 is slidably supported on the upper surfaces of guide walls 66 fixed on support surface 46 so as to be moved in the back-and-forth and the right-and-left directions. The lower end face of leg 50 has groove 68 extending along the back-and-forth direction. The upper end portion of shaft member 70 extending in the vertical direction is fitted to be movable in groove 68 only along the extension direction thereof. Shaft member 70 is located between guide walls 66 and guided by walls 66 along the right-and-left direction (the right-and-left direction of pen operation mechanism 22, i.e., the vertical direction in FIG. 1). Reference numeral 72 denotes a nut fixed at the outer edge of support surface 46 between guide walls 66; and reference numeral 74 denotes a right-and-left feed screw threadably engaged with nut 72. Feed screw 74 extends along the right-and-left direction of pen operation mechanism 22. The distal end portion of screw 74 rotatably extends through shaft member 70, and the proximal end portion thereof extends outside from the side surface of cover 24. Knob 76 is fixed to the proximal end of screw 74. Rotation of screw 74 in one or the other direction causes the right or left movement of pen operation mechanism 22 and the back or forth movement of shaft member 70, thereby causing right or left movement of pen operation mechanism 22 as a whole. In this case, pen operation mechanism 22 is pivoted about leg member 56 of rear support leg 48. Groove 68 formed in the lower end face of left support leg 50 prevents back-and-forth movement of shaft member 70 and hence pen operation mechanism 22.

The lower end face of right support leg 52 is slidable on support surface 46 along all directions.

Reference numerals 78 in FIGS. 1 and 3 denote tension coil springs hooked between legs 48, 50, and 52 and support surface 46, respectively. Pen operation mechanism 22 is securely held by means of springs 78 and is urged against support surface 46.

In the self-driven pen printer having the structure described above, when pen P is moved from the home position by pen operation mechanism 22 according to a predetermined pattern while running member 10 is stopped, signs such as characters and numeric values are drawn. However, when running member 10 is driven with a desired pattern while pen P is stopped at the home position, a desired figure can be drawn. In either mode, the pen tip can be kept in contact with paper surface during drawing. Upon completion of drawing, pen holder 30 is moved upward to separate the pen tip from the paper surface.

Figure 11:
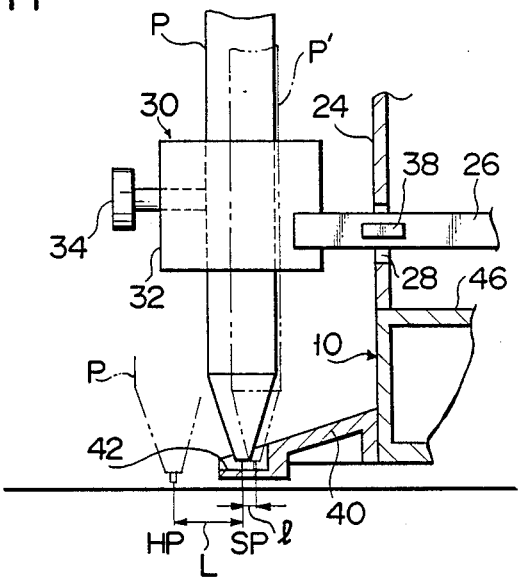
FIG. 11 is an enlarged side view schematically showing a pen holder portion so as to indicate pen tip position deviation of thin pen P′ at point SP, home position HP and point SP of thick pen P being indicated by the two-dots chain line and the solid line, respectively.

Replacement of pen P held in pen holder 30 will be described below. When predetermined drawing is completed, holder 30 is held in the upper position so as to separate the tip of pen P from the paper surface. Pen operation mechanism 22 withdraws the pen holder arm 26 to move pen holder 30 to the pen attaching position indicated by the two-dots chain line in FIG. 3. FIG. 11 shows this state in detail. The tip of pen P held in holder 30 is located at reference point SP separated from home position HP by predetermined length L. In other words, pen operation mechanism 22 moves pen holder arm 26 to a position separated from position HP by predetermined distance L. Since reference position SP is separated from home position HP by distance L, the pen tip is always located at point SP when pen P is attached to pen holder 30 or replaced with another pen. Pen holder 30 is not always located at home position HP upon completion of drawing. In this case, however, the tip of pen P held by pen holder 30 is moved to reference point SP upon completion of drawing.

After pen holder 30 is moved to the pen attaching position, pen P is removed from pen holder 30 and desired pen P′ is attached thereto, as indicated by the two-dots chain line in FIG. 11. The tip of pen P′ is in contact with pen receiving surface 42 of extension board 40. In this state, pen P′ is urged against the inner surface of hollow square rod 32 by pen fastening screw 34.

If the body diameter of pen P′ is smaller than that of the previous pen P, the tip of pen P′ held in pen holder 30 comes closer to pen holder arm 26 than the tip (i.e., home position HP) of pen P held by holder 30 by distance L. The tip of pen P' held by holder 30 located in the pen attaching position may be deviated from point SP in the right-and-left direction as well as the back-and-forth direction, as shown in FIG. 11.

In this case, back-and-forth feed screw 62 for feeding pen operation mechanism 22 along the back-and-forth direction and right-and-left feed screw 74 for feeding pen operation mechanism 22 along the right-and-left direction are rotated in one or the other direction to move pen operation mechanism 22 as a whole in all directions, thereby aligning the tip of pen P' with reference point SP.

Figure 12:
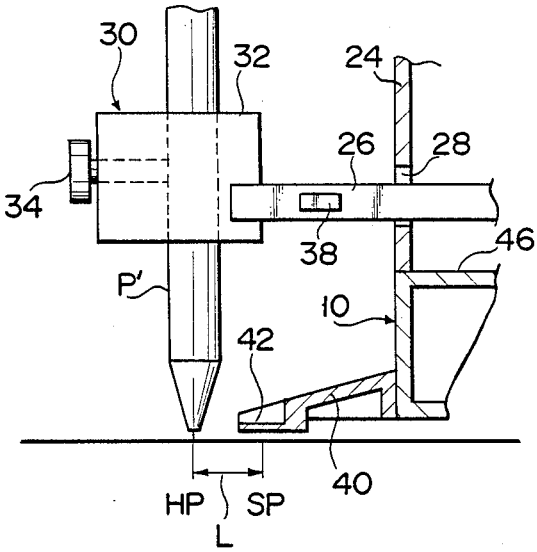
FIG. 12 is an enlarged side view schematically showing the pen holder portion for explaining the operation wherein thin pen P′ is adjusted to have its pen tip aligned with point SP and then moved to position HP.

Subsequently, pen operation mechanism 22 performs an arm push operation to move pen holder 30 by distance L toward position HP. Holder 30 is deviated from the position, where the tip of pen P is aligned with home position HP, by a displacement of pen operation mechanism 22 so as to align the tip of pen P' with reference point SP. The tip of pen P' held by holder 30 is aligned with position HP where pen P is used, as shown in FIG. 12. Pen P' uses position MP as the reference point to draw a desired figure or a desired sign such as a numeric value or a character.

A pen printer according to another embodiment for achieving a second object of the present invention will be described with reference to the accompanying drawings.

Reference numeral 100 in FIGS. 13 to 16 denotes a base of a pen operation mechanism. The pen operation mechanism in this embodiment is substantially the same as that of the previous embodiment but slightly differs therefrom in the structure of the pen holder. Base 100 comprises a horizontal plate. A pair of pulse motor units 102 and 104 are arranged on base 100 to drive a pen along any direction. Reference numeral 106 denotes a carrier frame of a metal plate horizontally disposed under base 100. Both sides of frame 106 are supported by Y guide shafts 108 arranged horizontally at both sides of base 100. Frame 106 is guided by shafts 108 along the Y-axis. Reference numeral 110 denotes a plastic pen support member arranged under carrier frame 106. Support member 110 consists of arm 112 extending along the moving direction of carrier frame 106, horizontal extension board 114 extending from the proximal end portion of arm 112 at one side thereof, and shaft support portion 116 extending parallel to arm 112. The proximal end of arm 112 of pen support member 110 and the center of shaft support portion 116 are supported by single horizontal X guide shaft 118 in frame 106 and are located below frame 106. Guide shaft 118 guides support member 110 along the X-axis perpendicular to the moving direction of frame 106. At the same time, shaft 118 causes support member 110 to pivot about shaft 118. Pen holder 120 is mounted at the distal end of arm 112 of support member 110. Holder 120 includes a pair of pen seats 122 vertically extending from the distal end of arm 112, and pen press member 126 mounted at the distal end of arm 112 by screws 124. Pen P is clamped between the V-shaped inner surface of press member 126 and pen seats 122.

Reference numerals 128 denote four pulleys rotatably mounted on the lower surface of carrier frame 106. Pulleys 128 are respectively located at corners of a parallelogram constituted by a pair of sides parallel to the Y-axis (the moving direction of carrier frame 106) and another pair of sides parallel to the X-axis (the moving direction of support member 110).

Figure 21:
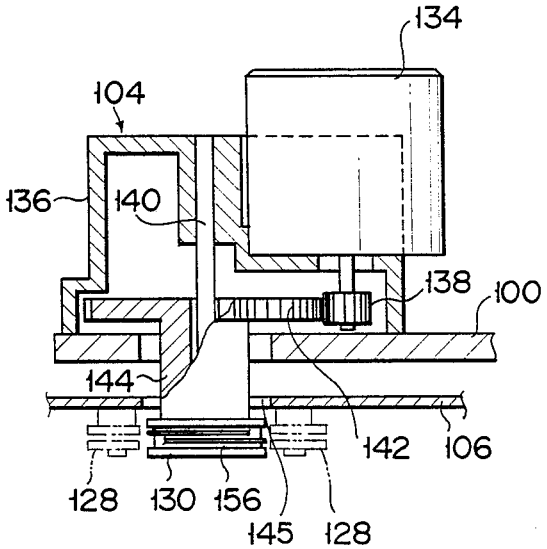
FIG. 21 is a sectional view schematically showing the section of a pulse motor unit in FIG. 14.

Reference numerals 130 denote a pair of rotary drums rotated in the forward/reverse direction by pulse motors 132 and 134 on base 100. Rotary drums 130 are spaced apart by a predetermined distance on a Y-direction line passing through middle points of the parallelogram whose corners define the positions of pulleys 128. In this embodiment, the distance between the pair of rotary drums 130 is sufficiently longer than the Y-axis length of the parallelogram. Drums 130 are located outside the parallelogram. FIG. 21 schematically shows the structure of pulse motor unit 104. The structure of pulse motor unit 102 is the same as that of unit 104. Reference numeral 136 denotes a case, a lower surface of which is open. Pulse motor unit 104 is mounted on base 100 by screwing case 136 to base 100. Pulse motor 134 is fixed to the outer surface of case 136 such that the rotating shaft is inserted in case 136. Drive gear 138 is fixed to the rotating shaft. Vertical shaft 140 is fixed in case 136. Rotary cylinder 144, integrally formed with reduction gear 142 meshed with drive gear 138, is rotatably supported on vertical shaft 140. Cylinder 144 extends below carrier frame 106. Drums 130 are mounted at the lower ends of cylinders 144 so as to be located at the same level as pulleys 128. Elongated opening 145 is formed in frame 106, and cylinder 144 of one drum 130 extends through opening 145. Notch 146 as an escape for cylinder 144 of the other rotary drum 130 is formed in the edge of the proximal end of frame 106.

One pulley 147 is supported at the upper side of the proximal portion of arm 112 of support member 110. Drive string fixing member 148 is mounted at the proximal end of support member 110 and can be moved relative thereto along the X-axis. Fixing member 148 has drive string fixing portion 150 at one end thereof and bearing 152 at the other end thereof. Fixing portion 150 and bearing 152 in fixing member 148 are slidably supported on X guide shaft 118 along the axial direction. Substantially C-shaped stopper 154 is integrally formed with the central portion of the proximal edge of extension board 114 of support member 110. Fixing member 148 is urged against stopper 154 through compression coil spring 158 for tensioning a drive string 156 by a tension force of drive string 156 coupled to fixing portion 150 and can be moved together with pen support member 110 along the X-axis.

Figure 17:
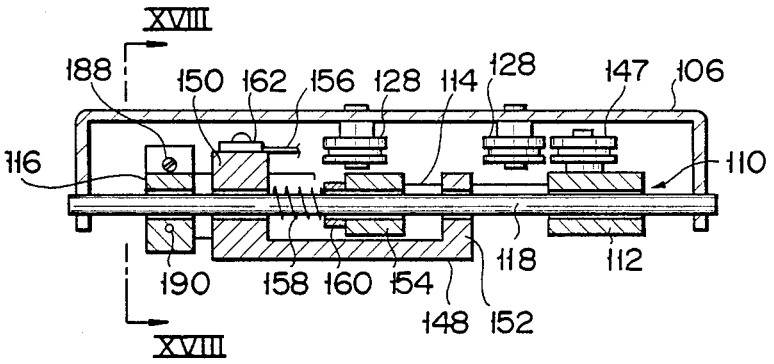
FIG. 17 is a schematic sectional view of the combination in FIG. 16 taken along the line XVII—XVII thereof.

More specifically, coil spring 158 is wound around guide shaft 118 between fixing portion of fixing member 148 and stopper 154 of pen support member 110, as shown in FIG. 17. One end of coil spring 158 abuts against fixing portion 150 and the other end thereof abuts against stopper 154 through spring seat ring 160 loosely fitted on guide shaft 118. Coil spring 158 biases fixing portion 150 and stopper 154 in a direction to separate them from each other. Drive string 156 coupled to fixing portion 150 is kept taut. At the same time, the tension force of drive string 156 causes urging of fixing portion 150 against stopper 154 through coil spring 158 and hence movement of fixing member 150 together with support member 110 along the X-axis.

Pulley 147 and fixing portion 150, which are mounted on the pen support member 110, are spaced apart by a predetermined distance on an X-direction line passing through the middle point of the parallelogram whose corners define the positions of four pulleys 128 mounted on carrier frame 106. In this embodiment, the distance between pulley 147 and fixing portion 150 in pen support member 110 is sufficiently long along the X-axis of the parallelogram to locate pulley 147 and fixing portion 150 outside the parallelogram. The drive string fixing position (the upper surface in this embodiment) in fixing portion 150 has the same level as those of four pulleys 128 in carrier frame 106 and the pair of rotary drums 130.

Figure 13:
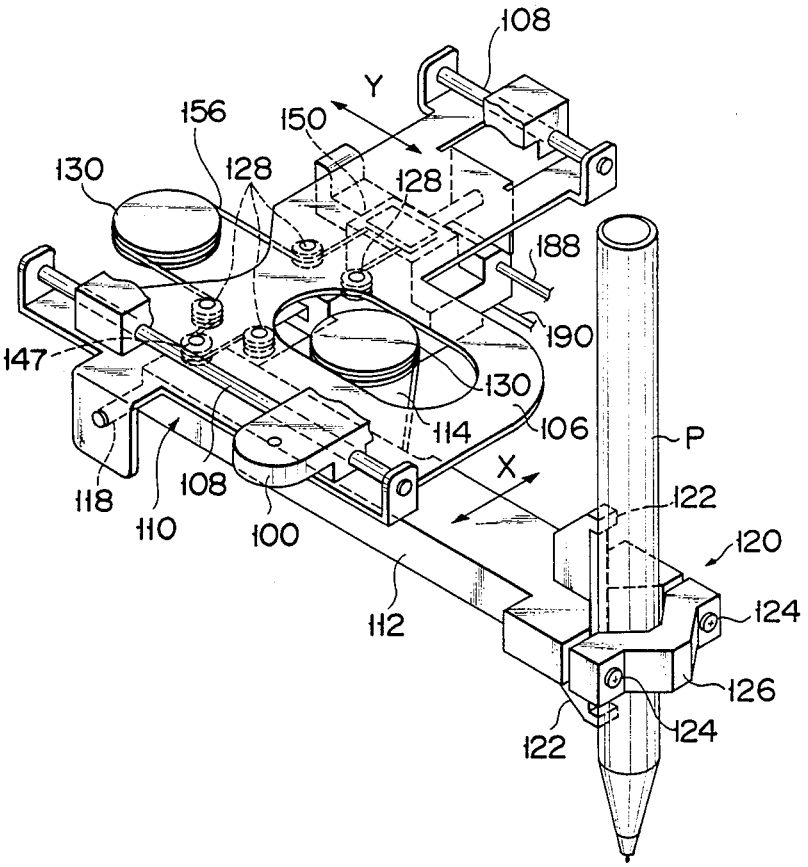
FIG. 13 is a perspective view showing a combination of a support member driven along the Y-axis and a carrier frame driven along the X-axis in a pen holder operation mechanism used in a pen printer of another embodiment for achieving the second object of the present invention.
Figure 16:
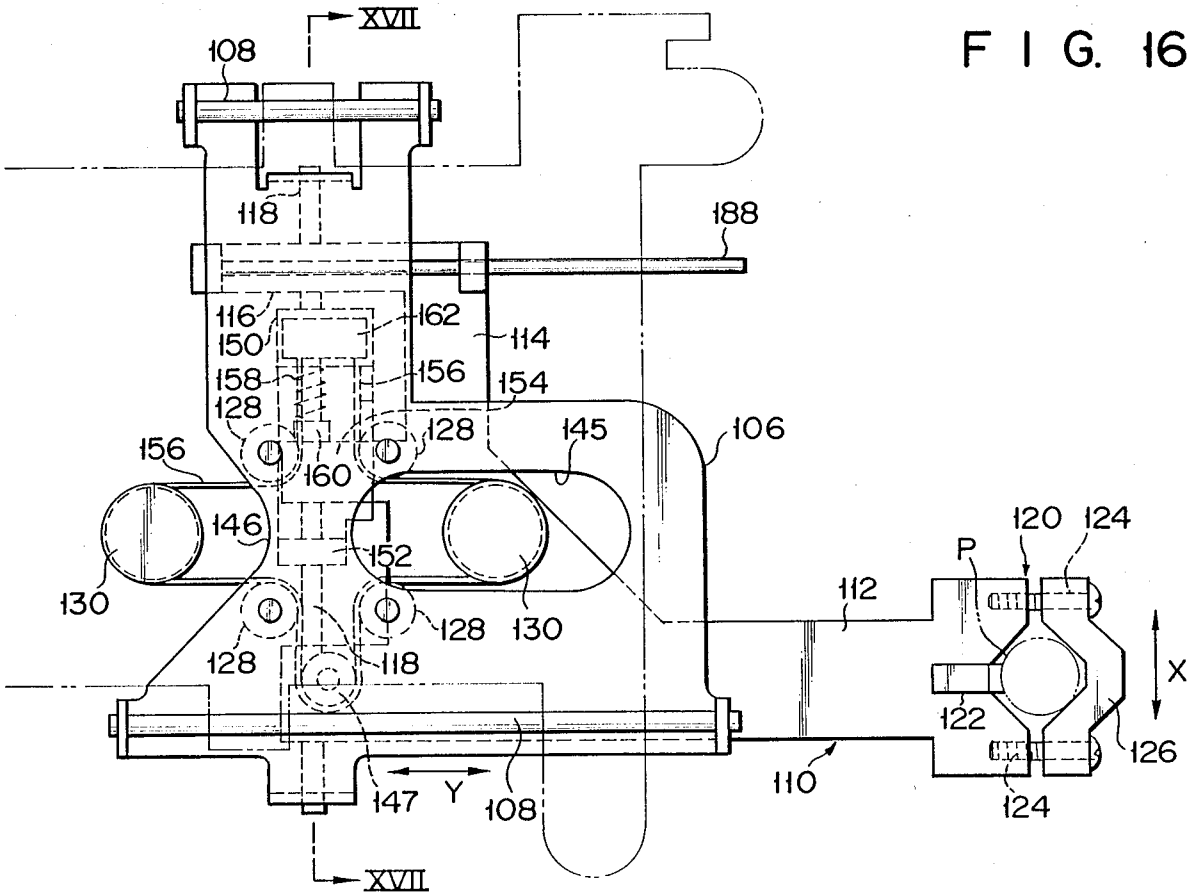
FIG. 16 is a plan view of the combination in FIG. 13.

Drive string 156 comprises a single wire (or a fabric string having anti-elongation properties) and causes frame 106 and support member 110 to move along the Y- and X-axes upon rotation of pulse motors 132 and 134 and hence the pair of rotary drums 130. Drive string 156 is looped around four pulleys 128 in frame 106, the pair of rotary drums 130, and pulley 147 of pen support member 110, as shown in FIGS. 13 and 16. Both ends of string 156 are coupled to fixing portion 150 of fixing member 148. As more specifically shown in FIG. 16, the intermediate portion of string 156 is wound around pulley 147 in support member 110. The string portion having a length from the intermediate portion to one end is first wound around right rotary drum 130 through lower right pulley 128 in frame 106, and one end thereof is then coupled to fixing portion 150 through upper right pulley 128 in frame 106. The string portion having a length from the intermediate portion to the other end is first wound around left rotary drum 130 through lower left pulley 128 in frame 106, and the other end thereof is coupled to fixing portion 150 through upper left pulley 128. Both ends of string 156 are fixed to the upper surface of fixing portion 150 by fixing plate 162 screwed thereon. String 156 is wound around drums 130 without causing slip therewith.

In this embodiment, since string 156 is kept taut by compression coil spring 158, drive string fixing member 148 is movable relative to pen support member 110. However, the tension of string 156 may be given by other means. For example, a spring force may act on the pair of drums 130 to separate them from each other. In this case, fixing member 148 may be integrally formed with support member 110.

Figure 14:
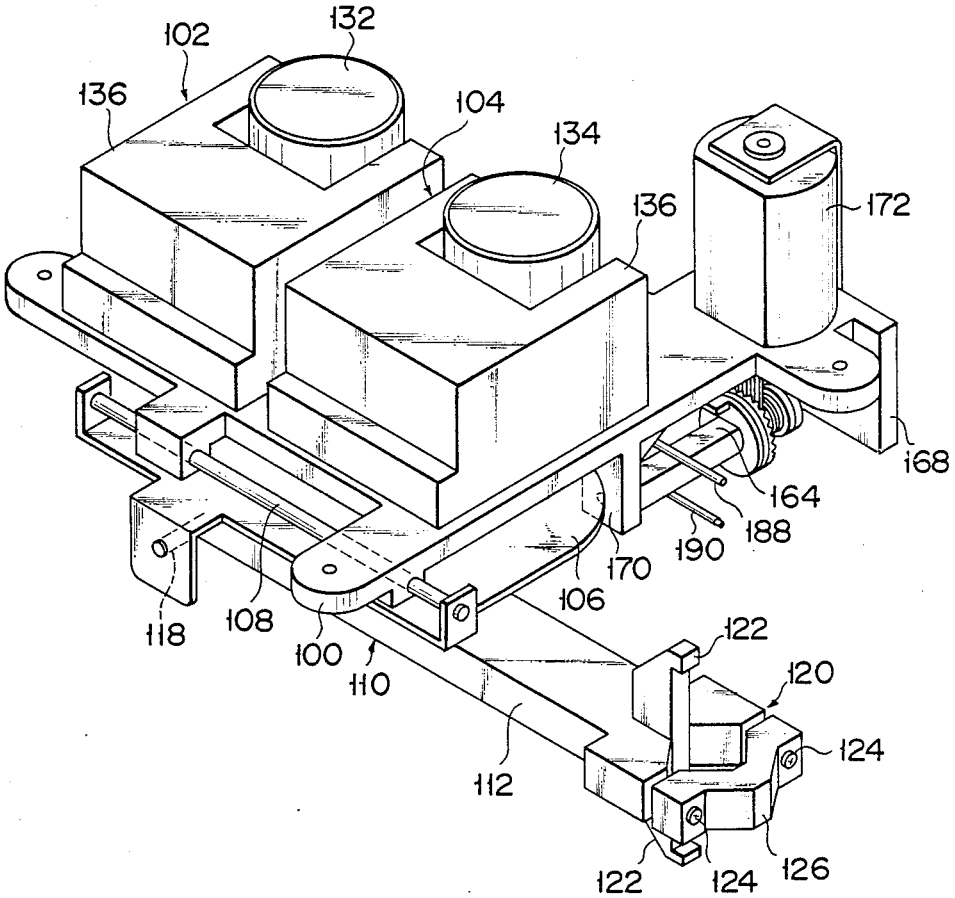
FIG. 14 is a perspective view showing the state where a combination of the pen support member and the carrier frame in FIG. 13 is mounted on a base for supporting a motor unit, the combination and the base constituting the pen holder operation mechanism.
Figure 15:
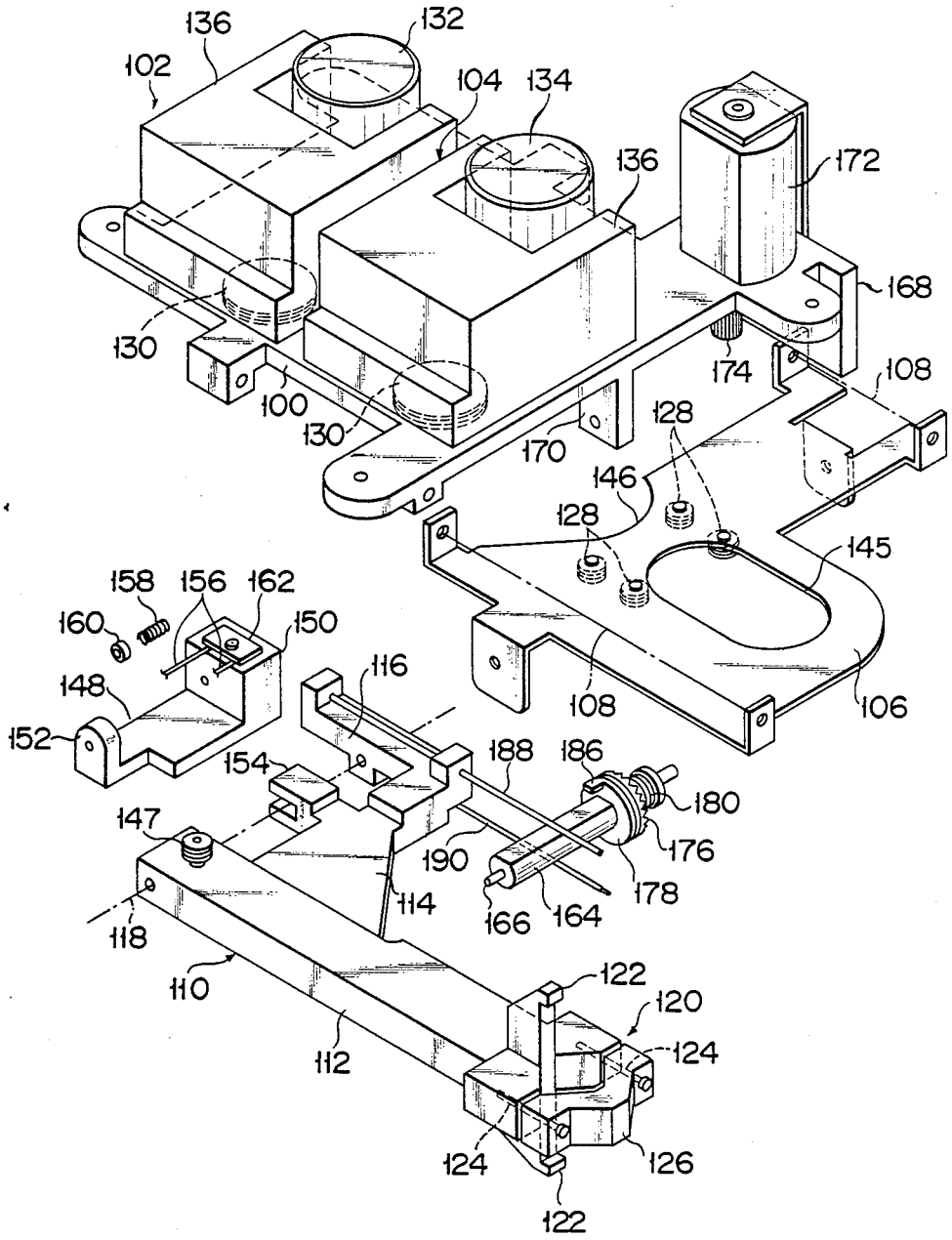
FIG. 15 is an exploded perspective view of the pen holder operation mechanism in FIG. 14.
Figure 19:
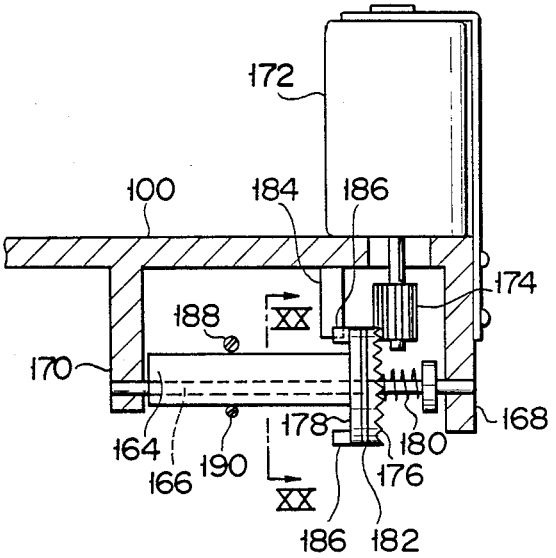
FIG. 19 is a cross-sectional view schematically showing the section taken along the line XIX—XIX of FIG. 18.
Figure 20:
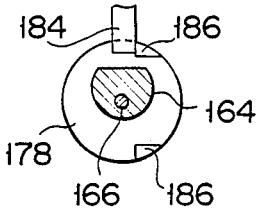
FIG. 20 is a sectional view schematically showing the section taken along the line XX—XX of FIG. 19.

Reference numeral 164 in FIGS. 14 and 15 denotes a pen vertical drive cam shaft for vertically pivoting pen support member 110 to bring pen P held by pen holder 120 into contact with paper surface or separate it therefrom. Cam shaft 164 is horizontally mounted on the lower surface of the distal end of base 100 along the X-axis. As best shown in FIGS. 19 and 20, cam shaft 164 comprises a round rod, the outer surface of which is partially notched along the entire length thereof. Cam shaft 164 is rotatably supported by support shaft 166 extending through a hole formed in an eccentric portion opposite the notched surface. Both ends of support shaft 166 are fixed to bearing plates 168 and 170 mounted on base 100. Reference numeral 172 denotes a pen vertical drive motor (a nonpulse motor) for driving cam shaft 164 in the forward or reverse direction. Motor 172 is mounted at the distal end portion of the upper surface of base 100. The rotating shaft of motor 172 extends below base 100. Reference numeral 174 denotes a cam shaft drive gear fixed on the rotating shaft of motor 172. Drive gear 174 is meshed with reduction gear 176 rotatably and slidably fitted on support shaft 166. Reference numeral 178 denotes disk clutch plate fixed on the end face of cam shaft 164. Reduction gear 176 is urged against clutch plate 178 through friction plate 182 by means of compression coil spring 180. Cam shaft 164 receives the rotational force from motor 172 through a friction clutch mechanism and is rotated through about 180 degrees such that the notched surface facing upward is moved to the position where the notched surface faces downward. Reference numeral 184 denotes a stopper mounted on the lower surface of base 100 to regulate the rotational angle of cam shaft 164. A pair of stopper seats 186 are formed on clutch plate 178. If cam shaft 164 is rotated through about 180 degrees, stopper seats 186 but against stopper 184. The friction clutch mechanism of this embodiment serves to prevent motor 172 from being overloaded when stopper seats 186 about against stopper 184 and rotation of cam shaft 164 is temporarily stopped. With this arrangement, the rotational speed of the motor 172 need not be reduced at the end of rotation of cam shaft 164. In addition, motor 172 need not be synchronously stopped at a predetermined stop position of cam shaft 164. Drive control of motor 172 can be simplified.

Figure 18:
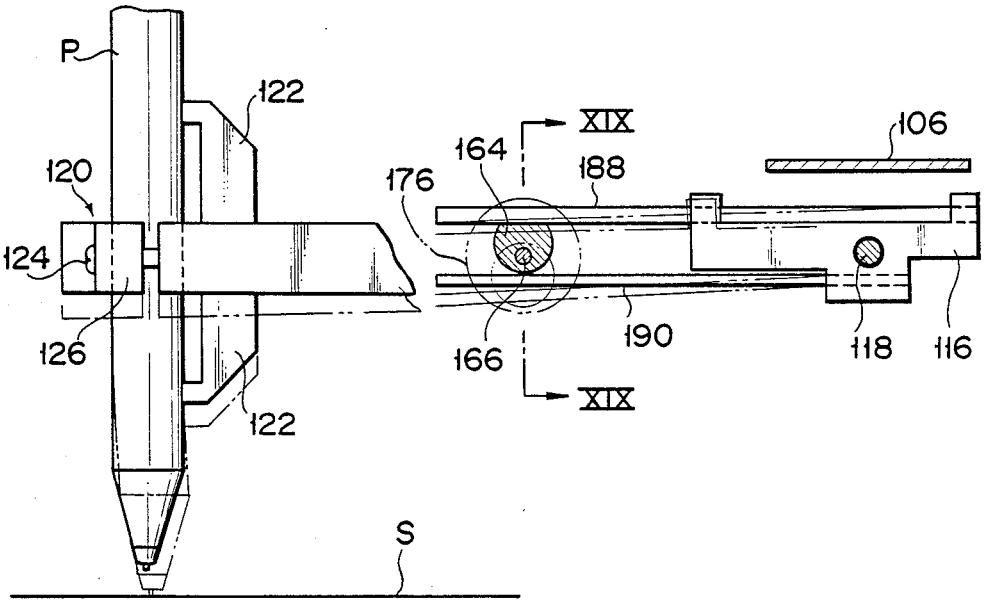
FIG. 18 is a sectional view schematically showing the longitudinal section of the combination of FIG. 16 when taken along the line XVIII—XVIII of FIG. 17, upper and lower positions of the pen holder member being indicated by the solid line and the broken line, respectively.

Reference numerals 188 and 190 denote upper and lower metal rods extending from shaft support portion 116 of pen support member 110 toward cam shaft 164 along the Y-axis. Upper metal rod 188 has a relatively large diameter and a relatively high rigidity. Lower metal rod 190 has a relatively small diameter and a relatively high elasticity. Two proximal end portions of rigid rod 188 are fixed to the upper surface of support portion 116. Only the proximal end portion of spring rod 190 is fixed to the lower surface of support portion 116. The distal ends of rods 188 and 190 vertically clamp cam shaft 164, as shown in FIGS. 18 and 20. Cam shaft 164 is long enough that rods 188 and 190 are not removed from cam shaft 164 even when pen support member 110 is moved along the X-axis.

An operation of a pen operation mechanism used in the pen printer of this embodiment will be described. The pen operation mechanism serves to cause pen vertical drive motor 172 to rotate pen vertical drive cam shaft 164, to pivot member 110 downward or upward, and hence to bring pen P held by pen holder 120 into contact with paper surface S or separate it therefrom. The pen operation mechanism also serves to cause motors 132 and 134 to rotate the pair of rotary drums 130 while pen P is in contact with paper surface S, to drive drive string 156 to move carrier frame 106 and pen support member 110 respectively along the X- and Y-axes, and hence to draw a sign such as a character or a numeric value with pen P.

The pen contact/release operation with respect to paper surface S is performed in the following manner.

When the flat notched surface of pen vertical drive cam shaft 164 faces upward, rigid rod 188 is urged upward by the notched surface. Pen support member 110 is pivoted upward about X guide shaft 118 so that pen P is separated from paper surface S, as shown in FIG. 18.

When drawing is started, motor 172 is rotated such that the flat notched surface of cam shaft 164 faces downward. In this state, spring rod 190 is urged downward by the notched surface of cam shaft 164. Pen support member 110 is pivoted downward about X guide shaft 118 so that pen P is brought into contact with paper surface S, as indicated by the one-dot chain line in FIG. 18. In practice, pen P is brought into contact with paper surface S before cam shaft 164 is completely rotated through 180 degrees. Spring rod 190 is further urged downward upon further rotation of cam shaft 164 after the tip of pen P comes in contact with paper surface P. Spring rod 190 is thus flexed, as indicated by the two-dots chain line in FIG. 18. Rigid rod 188 is separated upward from the outer surface of cam shaft 164. The restoration force of flexed spring rod 190 biases cam shaft 164 upward and a reaction force acts on pen support member 110, which is then pivoted downward. Therefore, pen P is urged against paper surface S with a suitable urging force by the spring force (restoration force) of spring rod 190. The urging force is maintained during drawing of signs such as characters and numeric values on paper surface S. In order to release pen P from paper surface S upon completion of drawing, pen vertical drive motor 172 is rotated until the flat notched surface of cam shaft 164 faces upward. In this state, rigid rod 188 is moved upward by the notched surface of cam shaft 164 to pivot pen support member 110 upward, thereby separating pen P from paper surface S.

In the pen operation mechanism, pen support member 110 is pivoted downward through rigid rod 188 upon rotation of cam shaft 164 and thus pen P is moved between the noncontact and contact positions. The downward speed of pen P can be controlled by rotation of cam shaft 164. Pen P can be gradually moved downward. As soon as pen P is brought into contact with paper surface S, spring rod 190 is flexed to absorb the instantaneous impact caused by contact between pen P and paper surface S, thereby preventing damage to the tip of pen P. During the operation for moving pen P from the contact position to the noncontact position, spring rod 190 is no longer flexed and pen support member 110 can be smoothly pivoted without causing a large frictional force to act on spring rod 190. The force required for pivotal movement of support member 110 can be small and power consumption of motor 172 for driving cam shaft 164 can also be small.

The operation for causing pen P to draw signs such as characters and numeric values will be described below.

Figure 22:
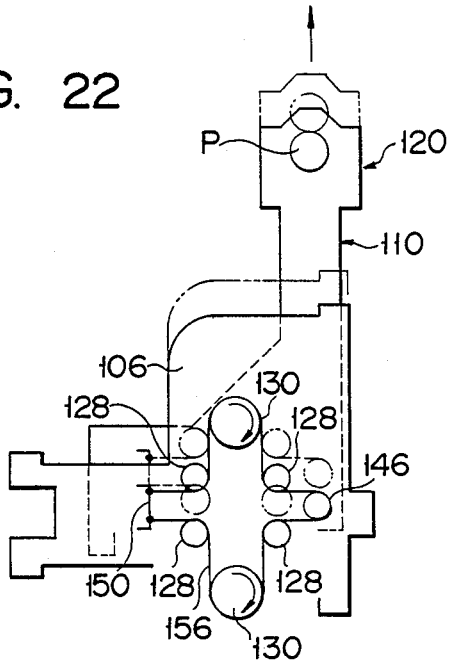

FIGS. 22 to 25 show different modes for moving pen P from the home position. As shown in FIG. 22, when the pair of rotary drums 130 are rotated clockwise, pulleys 128 receive the tension force from string 156 to move carrier frame 106 upward in FIG. 22 (the front direction of the pen printer with pen operation mechanism) and hence pen P in the front direction.

Figure 23:
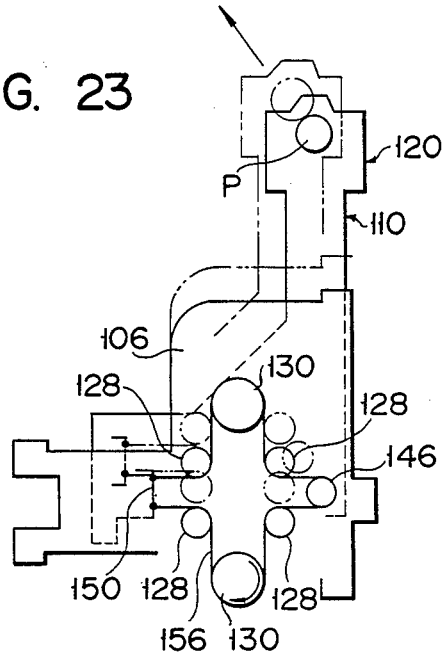

As shown in FIG. 23, when lower rotary drum 130 is rotated clockwise in the direction of the arrow while upper rotary drum 130 is stopped, pulleys 128 receive the tension force from strip 156 and at the same time pulley 147 also receives this force. Carrier frame 106 is moved upward in FIG. 23 (the front direction of the pen printer with the pen operation mechanism) and at the same time pen support member 110 is moved to the left. As a result, pen P is moved in the front left direction.

Figure 24:
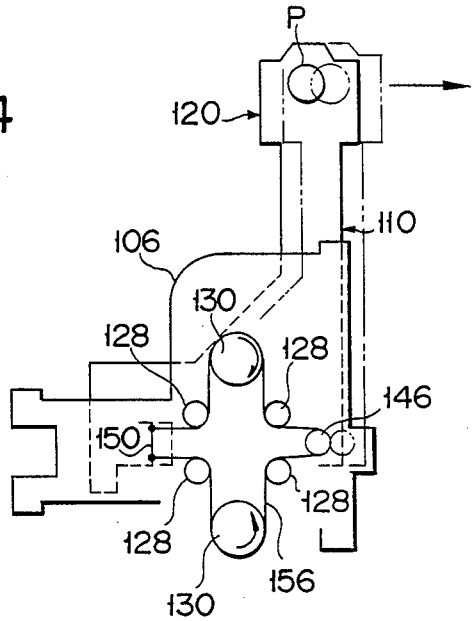

As shown in FIG. 24, when the pair of drums 130 are rotated in opposite directions, drive string fixing portion 150 in pen support member 110 receives the tension force of string 156 to move pen support member 110 to the right. As a result, pen P is moved to the right.

Figure 25:
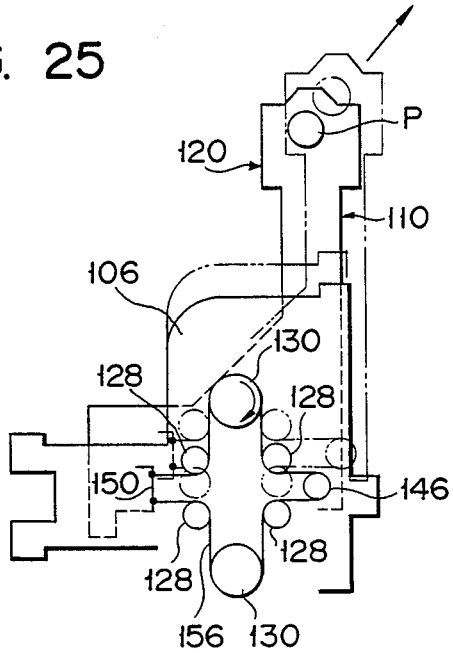

As shown in FIG. 25, when upper drum 130 is rotated clockwise in the direction of the arrow while lower drum 130 is stopped, pulleys 128 receive the tension force from string 156 and at the same time fixing portion 150 in pen support member 110 receives this force to move carrier frame 106 upward (the front direction of the pen printer with the pen operation mechanism). This moves pen support member 110 to the right. As a result, pen P is moved in the front right direction.

Even if rotary drums 130 are rotated in directions opposite the directions designated by the arrows, similar operations are performed, but pen P is moved in the opposite direction. In this embodiment, since drums 130 are moved by pulse motors 132 and 134, angular positions of drums 130 can be easily controlled with high precision. Therefore, the displacement of pen P can be controlled with high precision to accurately draw signs such as characters and numeric values.

In the pen operation mechanism described above, four pulleys 128 are respectively located at corners of the parallelogram constituted by two sides parallel to the Y-axis and two sides parallel to the X-axis. Drums 130 are spaced apart by a predetermined distance on a Y-axis line passing through the middle point of the parallelogram. Single pulley 146 and drive string fixing portion 150 are located on an X-axis line passing through the middle points of the parallelogram. Single string 156 is looped around four pulleys 128 in carrier frame 106, the pair of drums 130, and pulley 147 in pen support member 110. Both ends of string 156 are fixed to fixing portion 150 in pen support member 110. The pair of rotary drums 130 are rotated by motors 132 and 134 and string 156 is driven. Then, carrier frame 106 having four pulleys 128 and pen support member 110 having independent pulley 147 are respectively driven in the X- and Y-axes by the tension force of string 156. By rotating one of the pair of drums 130, both in one direction, or both in opposite directions, the tension force of string 156 can be varied. Carrier frame 106 driven along the Y-axis and pen support member 110 driven along the X-axis can be driven by the common drive system.

In the above embodiment, drums 130, pulley 146 in pen support member 110, and fixing portion 150 are located outside the parallelogram whose four corners define the positions of four pulleys 128 in carrier frame 106. However, these elements can be disposed inside the parallelogram.

A pen printer according to still another embodiment for achieving the third object of the present invention will be described with reference to the accompanying drawings.

Figure 26:
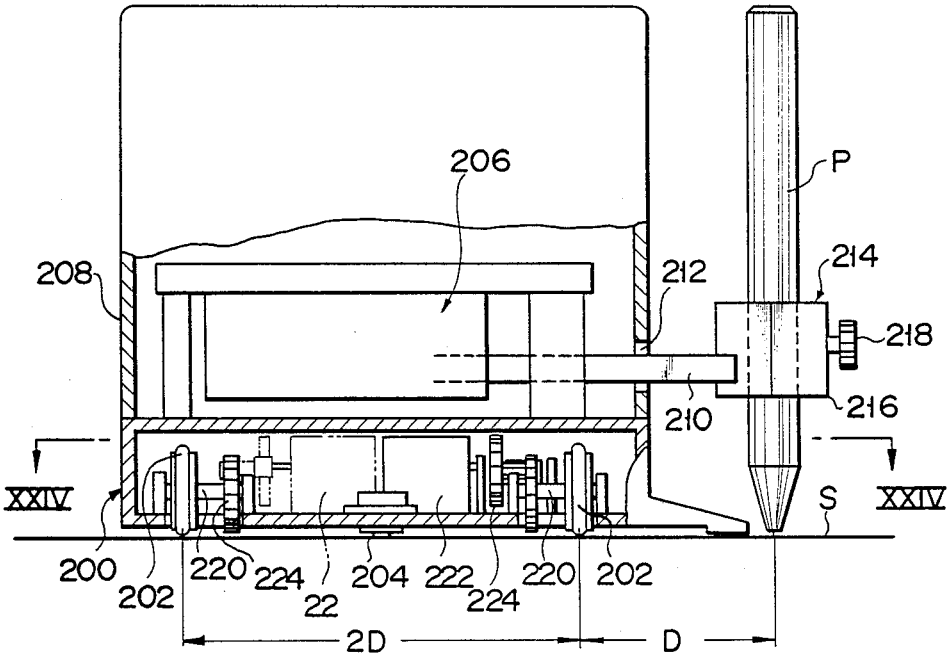
FIG. 26 is a side view of a pen printer according to still another embodiment for achieving the third object of the present invention, the side wall of the pen printer being partially removed.
Figure 27:
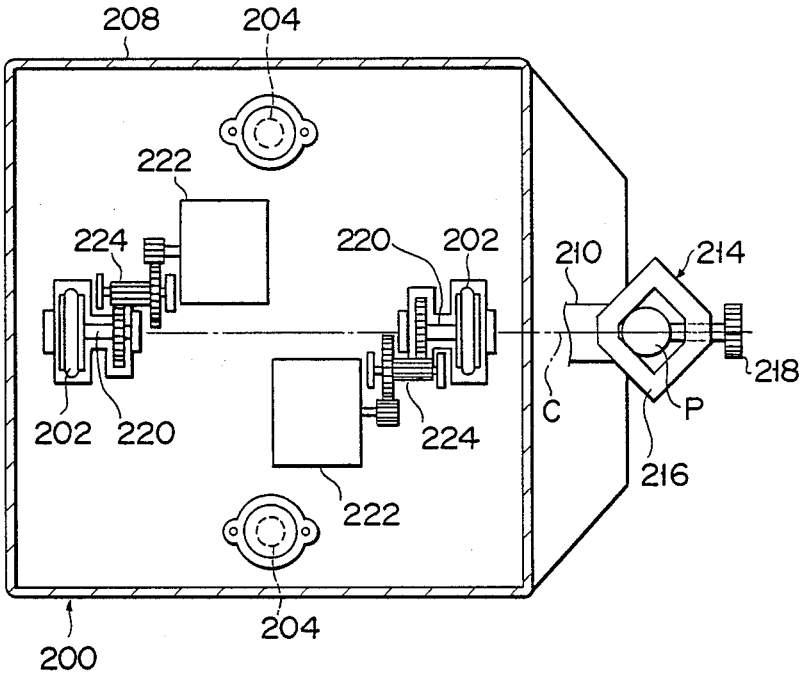
FIG. 27 is a horizontal sectional view of the pen printer in FIG. 26 taken along the line XXVII—XXVII thereof.

Reference numeral 200 in FIGS. 26 and 27 denotes a running member for running on paper surface S. Running member 200 includes drive wheels 202 at the centers of the front and rear portions thereof. Running member 200 also includes free-running ball wheels 204 at centers of the right and left sides thereof. Upon rotation of drive wheels 202, running member 200 runs along paper surface S.

The structure and functions of running member 200 in this embodiment are the same as those of running member 10 in the first embodiment.

Reference numeral 206 denotes a pen operation mechanism mounted in running member 200.

The structure and functions of pen operation mechanism 206 in this embodiment are substantially the same as those of pen operation mechanism 22 of the first embodiment and the pen operation mechanism of the second embodiment.

Pen operation mechanism 206 is covered with cover 208 mounted on running member 200. Cover 208 accommodates a battery (not shown) for driving running member 200 and pen operation mechanism 206, and a control circuit (not shown) for receiving control signals (radio wave or optical signals) from another control device (e.g., a combination of a personal computer and a printer control signal generator) independently of the self-driven pen printer of this embodiment and controlling running of running member 200 and operation of pen operation mechanism 206.

Reference numeral 210 denotes a pen holder arm arranged in pen operation mechanism 206. The distal end of arm 210 extends from an opening 212 formed in the front surface of cover 208. Reference numeral 214 denotes a pen holder mounted at the distal end of arm 210. Holder 214 comprises substantially hollow square rod 216, through which pen P extends, and pen fastening screw 218, threadably engaged with one side wall of square rod 216.

Pen operation mechanism 206 has a Z-axis feed function of moving arm 210 to bring the pen tip of pen P held in holder 214 into contact with paper surface S or separate it therefrom, and a sign writing function (i.e., the X-Y plotter function) for moving arm 210 along the X- and Y-axes to cause pen P held in holder 214 to draw signs such as characters and numeric values. The sign writing function is performed while running member 200 is stopped.

Axles 220 of drive wheels 202 in running member 200 are aligned so that wheels 202 are parallel to each other, as indicated by one-dot chain line C in FIG. 27. Drive wheels 202 can be rotated by pulse motors 222 through reduction gear mechanisms 224 in the forward or reverse direction. Drive wheels 202 are driven by motors 222 such that the rotational speeds of wheels 202 are given as an integer ratio.

Pen operation mechanism 206 causes pen holder 214 to temporarily move to the home position and then to a position for drawing a predetermined sign. However, when a figure is to be drawn, pen holder 214 is held in the home position for drawing the sign and running member 200 is moved according to a desired graphic pattern. The position (i.e., the home position for drawing the sign) of pen holder 214 for drawing the figure is located outside line C (FIG. 27) passing through the centers of axles of wheels 202 between wheels 202.

Distance D (FIG. 26) between the tip of pen P held in pen holder 214 and drive wheel 202 near pen holder 214 is shorter than the distance between two drive wheels 202. The ratio of distance D to the distance between wheels 202 is an integer.

The operation of the self-driven pen printer for drawing a figure upon movement of running member 200 will be described. Pulse motors 222 for driving drive wheels 202 have rotational speeds given as an integer ratio controlled by a drive control circuit (not shown). The rotational speeds of wheels 202 are controlled to obtain an integer ratio. When wheels 202 are driven in one direction at the same speed, pen P held in pen holder 214 draws a straight line. By changing the rotational speed ratio and one or both rotational directions, pen P in holder 214 draws an arc. The following table shows the relationship between rotational speed ratios of wheels 202 and tracks of pen P held in holder 214. Pen P traces tracks T1 to T10 in FIG. 28 according to the rotational speed ratios of wheels 202. Distance D between the pen tip and front wheel 202 is set to be ½ the distance of wheels 202 (i.e., the distance between drive wheels 202 is 2D).

TABLE

| Pen Track | Radius of Rotation (mm) | Center of Rotation | Front Wheel Speed:Rear Wheel Speed |
|---|---|---|---|
| T1 | 0 | $O_0$ | 1:3 |
| T2 | 1/2 | $O_1$ | 1:5 |
| T3 | 1 | $O_2$ | 0:1 |
| T4 | 3/2 | $O_3$ | −1:3 |
| T5 | 2 | $O_4$ | −1:1 |
| T6 | 5/2 | $O_5$ | −3:1 |
| T7 | 3 | $O_6$ | 1:0 |
| T8 | 7/2 | $O_7$ | −5:−1 |
| T9 | 4 | $O_8$ | −3:−1 |
| T10 | ∞ (straight) | — | −1:−1 |

Assuming the ratio of the speed of drive wheel 202 near pen holder 214 (to be referred to as a front wheel hereinafter) to the speed of drive wheel 202 away from pen holder 214 (to be referred to as a rear wheel hereinafter) is given as 1:3, when wheels 202 are rotated in the forward direction, running member 200 is rotated about point $O_0$ away from the rear wheel toward the front wheel by a distance of 3D (i.e., three times distance D between the centers of wheels 202). Therefore, pen P rotates by itself at point $O_0$ (the radius of rotation is 0).

If the ratio of front wheel speed to rear wheel speed is given as 1:5, running member 200 is turned about point $O_1$. Pen 7 is turned about point $O_1$ with the radius of rotation of D/2 and draws arc T2. In this case, the radius of arc T2 is ½ that of the minimum arc drawn by the conventional self-driven pen printer.

If the ratio of front wheel speed to rear wheel speed is given as 0:1 (the front wheel is stopped), running body 200 is turned about point $O_2$ and pen P is also turned about point $O_2$ with the radius of rotation of D and draws arc T3. The radius of arc T3 is the same as that of an arc drawn by the conventional self-driven pen printer.

When the ratio of front wheel speed to rear wheel speed is given as −1:3 (the front wheel is rotated in the reverse direction), running member 200 is turned about point $O_3$. Pen P is turned about point $O_3$ with the radius of (3/2)D and draws arc T4.

Figure 28:
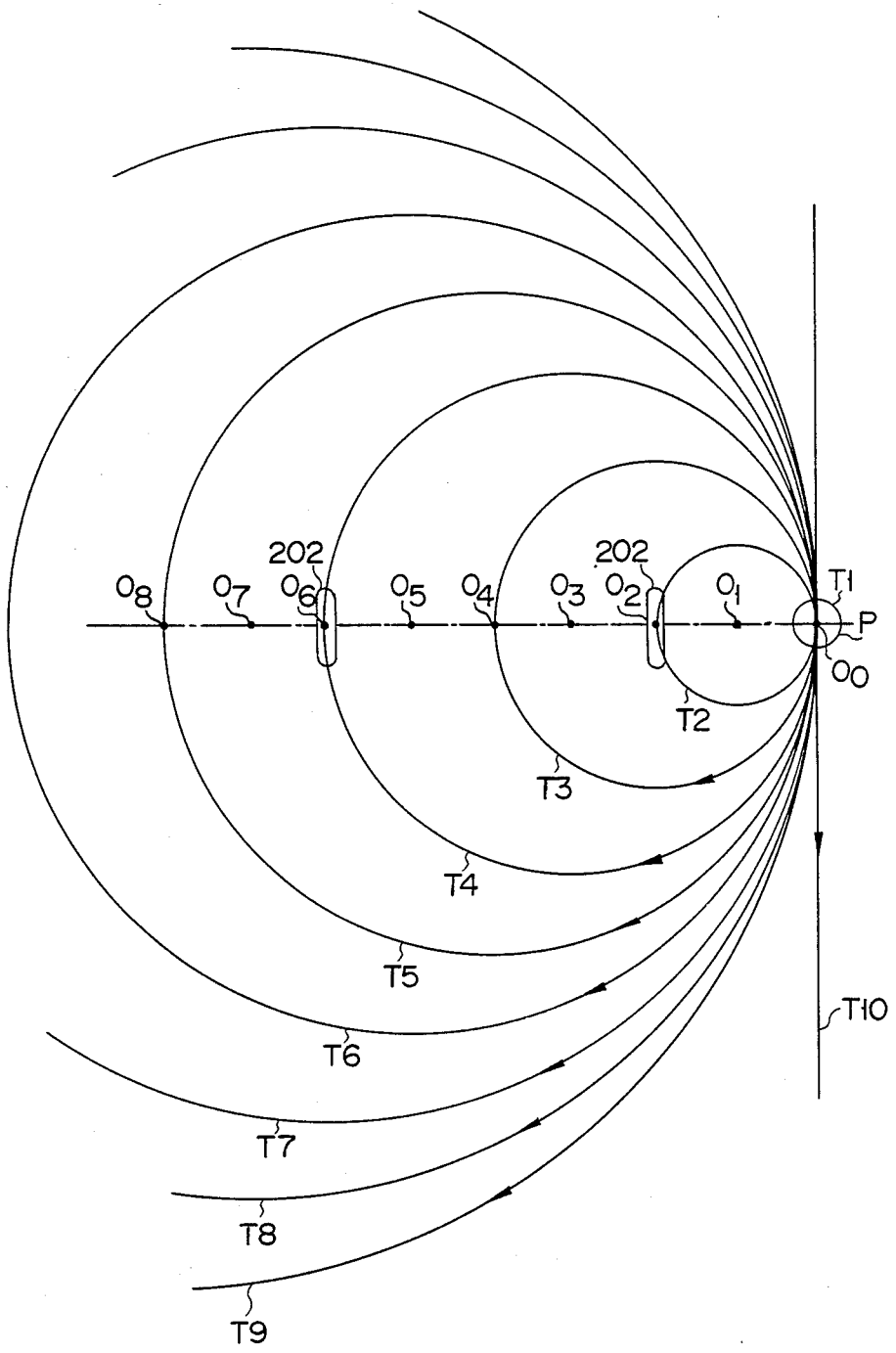
FIG. 28 is a view showing a line and arcs of different diameters drawn by the pen printer in FIG. 26.

Arcs having the centers O4 to O8 of rotation and radius in the above Table and FIG. 28 can be drawn according to rotational speed ratios in the same manner as described above. When the ratio of front wheel speed to rear wheel speed is −1:−1 (the front and rear wheels are rotated in the reverse direction at the same speed), running member 200 is linearly moved. Pen P is also linearly moved to draw line T10.

The ratio of front wheel speed to rear wheel speed for moving pen P in the direction of arrow in FIG. 28 is given. However, if pen P is moved in the opposite direction, the rotational directions of the front and rear wheels must be reversed.

According to the self-driven pen printer as described above in detail, pen holder 214 is located outside line C passing through axles 220 of wheels 202 between wheels 202. Running member 200 is turned about any point on line C to cause pen P to draw an arc. If the center of rotation of running member 200 is near pen holder 214 between wheels 202, pen P can draw an arc with a smaller radius. According to the self-driven pen printer of this embodiment, since pen holder 214 is mounted at the distal end of arm 210 extending outward from running body 200, pen P held by holder 214 can be externally observed. The operator can check the line drawn by pen P and control the running direction of the printer to obtain any figure.

In the self-driven pen printer of this embodiment, the ratio of the distance between pen holder 214 and the front wheel to the distance between two drive wheels 202 is given by an integer. Therefore, the relationship between the center and radius of rotation for turning running member 200 and the rotational speed ratios of two drive wheels 202 can be easily calculated. Since wheels 202 are respectively driven by pulse motors 222, the rotational speed ratios of drive wheels 202 can be digitally controlled. Therefore, the rotational speed ratios of drive wheels 202 can be easily controlled.

The above embodiments exemplify the present invention. The present invention is not limited to the particular embodiments described above. Various changes and modifications may be made within the spirit and scope of the invention. In the above embodiment, pen operation mechanism 206 can cause pen holder 214 to horizontally move in any direction so as to achieve the sign writing function. However, the pen operation mechanism may have a function for vertically moving pen holder 214 to bring pen P into contact with paper surface S or separate it therefrom. In the above embodiment, the distance between pen holder 214 and front wheel 202 is shorter than the distance between wheels 202. However, the distance between pen holder 214 and front wheel 202 may be longer than or the same as that between wheels 202. In this case, if running member 200 is turned about any point between the pen holder 214 and front wheel 202, an arc with a smaller radius can be drawn. In the above embodiment, the ratio of the distance between pen holder 214 and front wheel 202 to the distance between two drive wheels 202 is given as an integer. However, this ratio need not be an integer ratio. The motors for driving drive wheels 202 need not be pulse motors.

What is claimed is:

1. A pen printer for performing drawing with a detachably held pen; comprising:

a pen holder for detachably holding the pen;

a pen holder operation mechanism for moving said pen holder between a pen attaching position, where the pen is attached to or detached from said pen holder, and a home position, where drawing is started or ended, and for moving said pen holder from the home position for drawing a desired sign or figure according to a pattern corresponding to the desired sign or figure and causing said pen holder to return to the home position;

a support member for supporting said pen holder operation mechanism to be movable in all directions;

a pen seat, mounted on said support member, for receiving a tip of the pen held by said pen holder;

pen attaching position reference point display means, mounted on said pen seat, for displaying a pen attaching position reference point for the pen tip of the pen held by said pen holder; and pen holder operation mechanism moving means for moving said pen holder operation mechanism in all directions so as to align the pen tip of the pen held by said pen holder in the pen attaching position with the pen attaching position reference position.

2. A printer according to claim 1, wherein said pen holder operation mechanism moving means comprises front-and-back and right-and-left feed screws, threadably engaged with said support member or said pen holder operation mechanism to move back or forth upon rotation, for moving said pen holder operation mechanism in back-and-forth and right-and-left directions.

3. A printer according to claim 1, wherein said support member has running means which runs on a paper surface subjected to drawing with the pen held by said pen holder.

4. A printer according to claim 3, wherein said pen holder operation mechanism moving means comprises front-and-back and right-and-left feed screws, threadably engaged with said support member or said pen holder operation mechanism to move back or forth upon rotation, for moving said pen holder operation mechanism in back-and-forth and right-and-left directions.

5. A pen printer comprising a pen holder for detachably holding a pen and a pen holder operation mechanism for moving said pen holder according to a pattern corresponding to a desired sign or figure so as to cause the pen to draw the desired sign or figure on a paper surface, wherein said pen holder operation mechanism comprises:

a base;

a carrier frame supported on said base so as to be movable along a Y-axis;

a pen support member, supported by said carrier frame so as to be movable along an X-axis perpendicular to the Y-axis, for supporting said pen holder;

four pulleys rotatably mounted in said carrier frames, said four pulleys being respectively located at corners of a parallelogram having two parallel sides parallel to the Y-axis and two other parallel sides parallel to the X-axis;

a pair of rotary drums rotatably mounted on said base so as to be spaced apart on an X-axis line passing through a middle point of the parallelogram;

a pair of motors coupled to said pair of rotary drums to independently rotate said pair of rotary drums in a forward or reverse direction;

a pulley and a drive string fixing portion which are mounted on said pen support member, said pulley and said drive string fixing portion being spaced apart on an X-axis line passing through the middle point of the parallelogram; and a drive string looped around said pulley of said pen support member, two of said four pulleys which are near said pulley of said pen support member, said pair of rotary drums on said base, and the remaining two of said four pulleys which are near said drive string fixing portion on said pen support member, both ends of said drive string being fixed to said drive string fixing portion on said pen support member.

6. A printer according to claim 5, wherein said pair of motors are stepping motors, respectively.

7. A printer according to claim 5, further comprising a base support member for supporting said base of said pen holder operation mechanism, said base support member being provided with running means which runs on the paper surface subjected to drawing with the pen held by said pen holder.

8. A printer according to claim 7, wherein said pair of motors are stepping motors, respectively.

9. A printer according to claim 5, wherein said pen holder operation mechanism moves said pen holder between a pen attaching position, where the pen is attached to or detached from said pen holder, and a home position, where drawing is started or ended, and moves said pen holder from the home position for drawing a desired sign or figure according to a pattern corresponding to the desired sign or figure and causes said pen holder to return to the home position, and further comprising:

a support member for supporting said base of said pen holder operation mechanism to be movable in all directions;

a pen seat, mounted on said support member, for receiving a tip of the pen held by said pen holder;

pen attaching position reference point display means, mounted on said pen seat, for displaying a pen attaching position reference point for the pen tip of the pen held by said pen holder; and pen holder operation mechanism moving means for moving said pen holder operation mechanism in all directions so as to align the pen tip of the pen held by said pen holder in the pen attaching position with the pen attaching position reference position.

10. A printer according to claim 9, wherein said pen holder operation mechanism moving means comprises front-and-back and right-and-left feed screws, threadably engaged with said support member or said base of said pen holder operation mechanism to move back or forth upon rotation, for moving said pen holder operation mechanism in back-and-forth and right-and-left directions.

11. A printer according to claim 9, wherein said support member has running means which runs on a paper surface subjected to drawing with the pen held by said pen holder.

12. A pen printer for performing drawing with a detachably held pen, comprising:

a pen holder for detachably holding the pen;

a pen holder operation mechanism for vertically moving said pen holder to bring the pen held by said pen holder into contact with a flat paper surface subjected to drawing of a desired sign figure or to separate the pen therefrom; and a running member for accommodating said pen holder operation mechanism therein, said running member being provided with two drive wheels spaced away from each other, rotating center axes of said two drive wheels being aligned, and wheel drive means for independently driving each of said two drive wheels, said pen holder operation mechanism being provided with an arm means for positioning a tip of said pen holder outside said running member and in a plane substantially perpendicular to said flat paper surface, said plane including therein a straight line passing through said axes of said two drive wheels.

13. A printer according to claim 12, wherein a distance between said pen holder and one of said drive wheels which is close to said pen holder is shorter than a distance between said two drive wheels.

14. A printer according to claim 13, wherein a ratio of the distance between said pen holder and one of said drive wheels which is close to said pen holder to the distance between said two drive wheels is an integer.

15. A printer according to claim 14, wherein, said wheel driving means of said running member an selectively rotate said two drive wheels such that a ratio of two drive wheel speeds is an integer ratio other than 1.

16. A printer according to claim 15, wherein said wheel driving means comprises two stepping motors coupled to said two drive wheels.

17. A printer according to claim 12, wherein said pen holder operation mechanism moves said pen holder between a pen attaching position, where the pen is attached to or detached from said pen holder, and a home position, where drawing is started or ended, and moves said pen holder from the home position for drawing a desired sign or figure according to a pattern corresponding to the desired sign or figure and causes said pen holder to return to the home position, and further comprising:

a support member for supporting said pen holder operation mechanism to be movable in all directions;

a pen seat, mounted on said support member, for receiving a tip of the pen held by said pen holder;

pen attaching position reference point display means, mounted on said pen seat, for displaying a pen attaching position reference point for the pen tip of the pen held by said pen holder; and pen holder operation mechanism moving means for moving said pen holder operation mechanism in all directions so as to align the pen tip of the pen held by said pen holder in the pen attaching position with the pen attaching position reference position.

18. A printer according to claim 17, wherein said pen holder operation mechanism moving means comprises front-and-back and right-and-left feed screws, threadably engaged with said support member or said pen holder operation mechanism to move back or forth upon rotation, for moving said pen holder operation mechanism in back-and-forth and right-and-left directions.

19. A printer according to claim 12, wherein said pen holder operation mechanism comprises:

a base;

a carrier frame supported on said base so as to be movable along a Y-axis;

a pen support member, supported by said carrier frame so as to be movable along an X-axis perpendicular to the Y-axis, for supporting said pen holder;

four pulleys rotatably mounted in said carrier frames, said four pulleys being respectively located at corners of a parallelogram having two parallel sides parallel to the Y-axis and two other parallel sides parallel to the X-axis;

a pair of rotary drums rotatably mounted on said base so as to be spaced apart on an X-axis line passing through a middle point of the parallelogram;

a pair of motors coupled to said pair of rotary drums to independently rotate said pair of rotary drums in a forward or reverse direction;

a pulley and a drive string fixing portion which are mounted on said pen support member, said pulley and said drive string fixing portion being spaced apart on an X-axis line passing through the middle point of the parallelogram; and a drive string looped around said pulley of said pen support member, two of said four pulleys which are near said pulley of said pen support member, said pair of rotary drums on said base, and the remaining two of said four pulleys which are near said drive string fixing portion on said pen support member, both ends of said drive string being fixed to said drive string fixing portion on said pen support member, wherein said pen holder is moved according to a pattern corresponding to a desired sign or figure so as to cause the pen held by said pen holder to draw the desired sign or figure on a paper surface.

20. A printer according to claim 19, wherein said pair of motors are stepping motors, respectively.

21. A printer according to claim 19, wherein said pen holder operation mechanism moves said pen holder between a pen attaching position, where the pen is attached to or detached from said pen holder, and a home position, where drawing is started or ended, and moves said pen holder from the home position for drawing a desired sign or figure according to a pattern corresponding to the desired sign or figure and causes said pen holder to return to the home position, and further comprising:

a support member for supporting said pen holder operation mechanism to be movable in all directions;

a pen seat, mounted on said support member, for receiving a tip of the pen held by said pen holder;

pen attaching position reference point display means, mounted on said pen seat, for displaying a pen attaching position reference point for the pen tip of the pen held by said pen holder; and pen holder operation mechanism moving means for moving said pen holder operation mechanism in all directions so as to align the pen tip of the pen held by said pen holder in the pen attaching position with the pen attaching position reference position.

22. A printer according to claim 21, wherein said pen holder operation mechanism moving means comprises front-and-back and right-and-left feed screws, threadably engaged with said support member or said base of said pen holder operation mechanism to move back or forth upon rotation, for moving said pen holder operation mechanism in back-and-forth and right-and-left directions.

* * * * *